US008736261B2

(12) United States Patent
Hiramoto et al.

(10) Patent No.: US 8,736,261 B2
(45) Date of Patent: May 27, 2014

(54) SENSOR MODULE

(75) Inventors: Satoru Hiramoto, Chita (JP); Yoshiyuki Kono, Obu (JP); Akitoshi Mizutani, Okazaki (JP); Takamitsu Kubota, Chiryu (JP); Koichiro Matsumoto, Kyoto (JP)

(73) Assignee: Denso Corporation, Kariya (JP)

( * ) Notice: Subject to any disclaimer, the term of this patent is extended or adjusted under 35 U.S.C. 154(b) by 268 days.

(21) Appl. No.: 13/348,904

(22) Filed: Jan. 12, 2012

(65) Prior Publication Data

US 2012/0181641 A1 Jul. 19, 2012

(30) Foreign Application Priority Data

Jan. 13, 2011 (JP) ..... 2011-4901

(51) Int. Cl.
*G01B 7/30* (2006.01)

(52) U.S. Cl.
USPC ..... 324/207.25; 324/538; 324/750.15; 324/750.16; 324/756.05; 324/762.01

(58) Field of Classification Search
CPC ..... G01D 5/00; G01D 5/145; G01D 5/147; G01D 5/2451; G01D 11/245; G01P 3/487
USPC ..... 324/207.25, 538, 750.15, 750.16, 324/756.05, 762.01
See application file for complete search history.

(56) References Cited

U.S. PATENT DOCUMENTS 6,005,401 A * 12/1999 Nakata et al. ..... 324/756.03
6,008,639 A * 12/1999 Hiraoka et al. ..... 324/174
6,407,543 B1 6/2002 Hagio et al.
6,598,587 B2 * 7/2003 Kamimura et al. ..... 123/399
6,601,453 B2 * 8/2003 Miyazaki et al. ..... 73/754
6,615,669 B1 * 9/2003 Nishimura et al. ..... 73/756
7,347,737 B2 * 3/2008 Horiba ..... 439/676
2002/0144554 A1 * 10/2002 Ueyanagi et al. ..... 73/700
2007/0247322 A1 * 10/2007 Shinjo ..... 340/626
2009/0146648 A1 * 6/2009 Iwahashi et al. ..... 324/207.25
2011/0095770 A1 * 4/2011 Kurashima ..... 324/679

FOREIGN PATENT DOCUMENTS

JP 7-181192 7/1995
JP 9-17514 1/1997
JP 2004-004114 1/2004

OTHER PUBLICATIONS

Office Action (1 page) dated Nov. 6, 2012, issued in corresponding Japanese Application No. 2011-004901 and English translation (2 pages).

* cited by examiner

*Primary Examiner* — Huy Q Phan
*Assistant Examiner* — Giovanni Astacio-Oquendo
(74) *Attorney, Agent, or Firm* — Nixon & Vanderhye PC

(57) ABSTRACT

A sensor module includes a sensor, a cover, and a wiring unit. The cover holds the sensor and includes a connector configured to make a connection with an external device. The wiring unit is held by the cover, is arranged from the connector to the sensor, and includes a connecting member extending from the connector to a central region of the cover in its width direction, which is perpendicular to the central line, and a wiring member extending from the central region of the cover in its width direction to a vicinity of the sensor. The cover and connecting member are integrally formed from a mold material. The connecting member includes a first connecting terminal exposed from a surface of the mold material at the central region of the cover in its width direction. The wiring member includes a second connecting terminal conductively joined to the first connecting terminal.

9 Claims, 7 Drawing Sheets

SENSOR MODULE

CROSS REFERENCE TO RELATED APPLICATION

This application is based on and incorporates herein by reference Japanese Patent Application No. 2011-4901 filed on Jan. 13, 2011.

BACKGROUND OF THE INVENTION

1. Field of the Invention

The present invention relates generally to a sensor module. In particular, the present invention relates to a sensor module used for an electronic throttle device.

2. Description of Related Art

Conventional technologies will be described below. Conventionally, an electronic throttle device that controls a flow rate of intake air flowing in the inside (throttle bore) of a throttle body, which is incorporated along an intake pipe of an internal combustion engine (engine), by opening and closing operations of a throttle valve, is widely known. A sensor module that detects an opening degree of the throttle valve is disposed at the throttle body which accommodates the throttle valve (see, for example, JP-A-2004-004114 corresponding to U.S. Pat. No. 6,407,543 B1). The sensor module includes a throttle opening degree sensor that has a Hall IC for outputting an electrical signal corresponding to a density of magnetic flux released from a magnet rotor, which rotates together with the throttle valve; and a sensor cover made of insulating resin (insulating material) that has a connector, which holds the throttle opening degree sensor and connects with an external device.

Connector terminals that constitute a sensor connector wire of the throttle opening degree sensor are inserted (embedded and held) into the sensor cover. Connector end terminals projecting into the inside of a housing of the connector are formed on one end sides of the connector terminals. A connecting terminal, which is electrically connected and joined to a sensor lead terminal of the Hall IC, is formed on the other end sides of the connector terminals. The sensor module described in JP-A-2004-004114 is capable of preventing misalignment of a positional relationship between the magnet rotor fixed to a shaft of the throttle valve, and the throttle opening degree sensor held by the sensor cover. Accordingly, the sensor module can detect with high accuracy the degree of opening of the throttle valve (rotation information of the throttle valve) which is a detection object.

Defects of the conventional technologies will be described below. However, in the case of the sensor module described in JP-A-2004-004114, another sensor cover having a different shape from the present sensor cover may be produced due to, for example, constraints on the position for disposing the module. For example, if the sensor cover, with a direction of the connector, i.e., projecting direction (connector connecting direction) of the connector end terminal of the connector terminal reversed, is additionally produced, the shape of the end terminal of the connector terminal needs to conform to the shape of the additional sensor cover. Since the connector terminal having the end terminal in a shape that is in accordance with the shape of the additional sensor cover needs to be newly provided, the production costs for the connector terminal will increase as a result of the newly provided connector terminal. Moreover, because the sensor connector wire from the connector to the throttle opening degree sensor is configured by the connector terminal, which is an integral part, the connector terminals cannot easily be two-level crossed thereby to lower a degree of flexibility in wiring for an inner surface shape of the sensor cover.

The production costs of the connector terminal may be reduced by making employable one type of the connector terminal with its end terminal in the same shape commonly for more than one type of the sensor covers having different shapes from each other. However, a shape having a difference in height (level difference) on an inner surface of the sensor cover, which is currently incorporated into the sensor module (present sensor cover), is used for the present sensor cover. Therefore, a level difference is provided also for the connector terminal in conformity with the shape of this sensor cover. Thus, if the connector terminal is used with its surface having front and rear sides reversed, the shape of the sensor cover and the shape of the connector terminal do not conform with each other, so that the above-described proposal is not introducible. Furthermore, if the connector terminal is formed into a flat surface shape without a level difference in order to conform the shape of the sensor cover to the shape of the connector terminal, the size of the connector becomes larger than the size of the sensor cover. Consequently, the size of the entire sensor module is made large, so that it may be difficult to ensure a space for disposing the module.

A connector-integrated electronic circuit, in which a connector terminal is inserted into a connector housing, is described in JP-A-H09-017514. In the connector terminal, a component attachment portion for attaching an electronic component and a connector terminal portion for connection to an external circuit are connected and integrated in their length direction. According to this circuit, since the long connector terminal is inserted into the connector housing, there is a concern that the connector terminal cannot be set in an orderly fashion in a resin molding die for insert molding, due to a manufacturing variation of the connector terminal. In addition, the connector terminal is deformed at the time of insert molding into the connector housing, and the size of the connector-integrated electronic circuit thereby becomes non-standard to increase its level of defectiveness. As a result, there is a problem of the decreased productivity.

SUMMARY OF THE INVENTION

The present invention addresses at least one of the above disadvantages.

According to the present invention, there is provided a sensor module for detecting information about a measuring object. The sensor module includes a sensor, a module cover, and a wiring unit. The sensor includes a semiconductor device configured to output to an outside a signal which corresponds to the information about the measuring object. The module cover holds the sensor and includes a connector configured to make a connection with an external device. The wiring unit is held by the module cover and is arranged from the connector to the sensor. The wiring unit includes a connecting member and a wiring member. The connecting member extends from the connector to a central region of the module cover in its width direction, which is perpendicular to a central line of the module cover in a longitudinal direction thereof. The wiring member extends from the central region of the module cover in its width direction to a vicinity of the sensor. The module cover and the connecting member are integrally formed from a mold material having insulation properties. The connecting member includes a first connecting terminal that is exposed from a surface of the mold material at the central region of the module cover in its width direction. The wiring member includes a second connecting terminal that is conductively joined to the first connecting terminal.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Embodiments of the invention will be described below in detail in reference to the accompanying drawings. The invention achieves the objective of improvement of a degree of flexibility in wiring of a wiring unit by integrally forming a module cover and a connecting member from a mold material, and by exposing a first connecting terminal of the connecting member from a surface of the mold material at the central part of the module cover in its width direction so that the first connecting terminal can be conduction-joined to a second connecting terminal of a wiring member. Moreover, even though a module cover having a different shape from an existing module cover is produced, and even though a module cover having at least one level difference is used, the invention achieves the objective of prevention of increase of production costs due to a newly-provided connecting member (terminal conductor group) by exposing a first connecting terminal of a connecting member from a surface of a mold material at the central part of the module cover in its width direction so that the first connecting terminal can be conduction-joined to a second connecting terminal of a wiring member.

First Embodiment

Figure 1A:
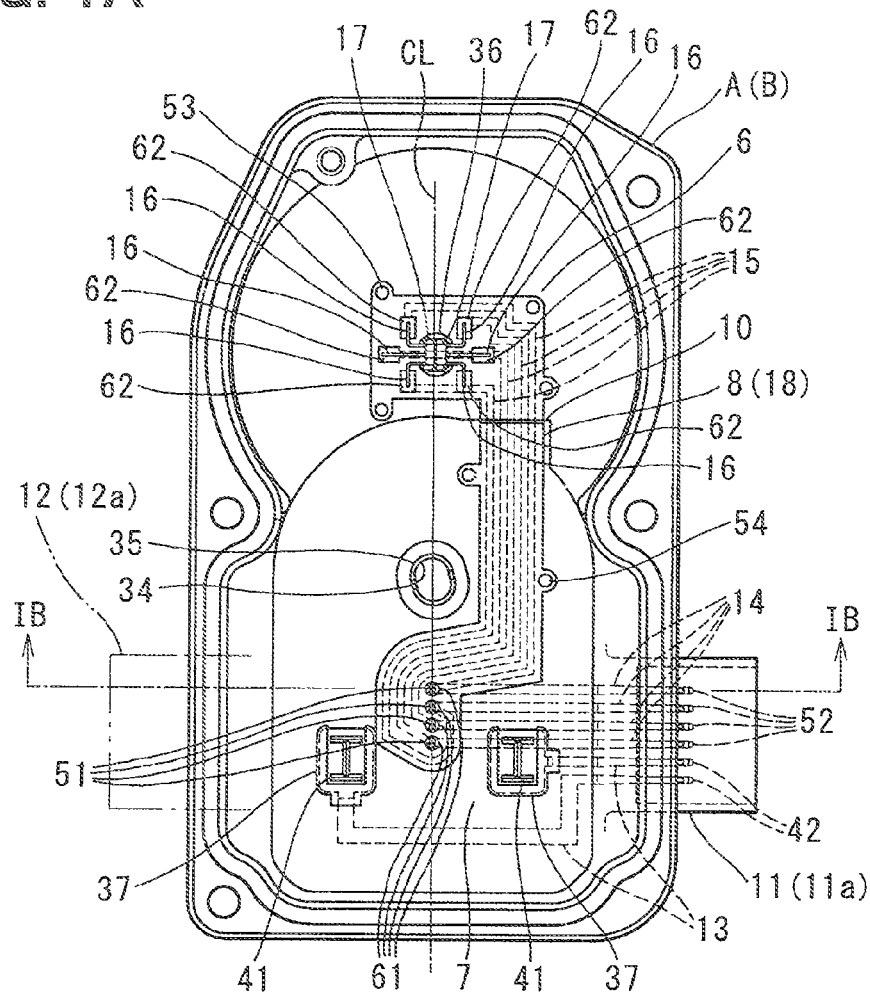
FIG. 1A is a plan view illustrating a wiring unit of a first module cover (second module cover) in accordance with a first embodiment of the invention.
Figure 1B:
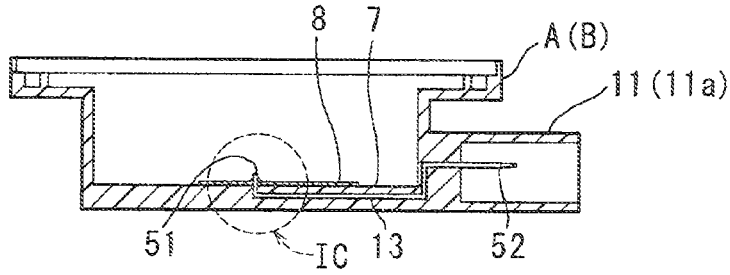
FIG. 1B is a cross-sectional view taken along a line IB-IB in FIG. 1A.
Figure 1C:
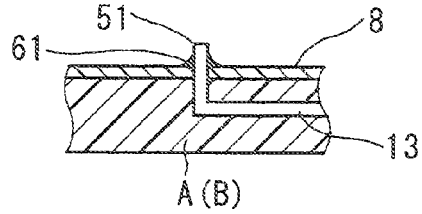
FIG. 1C is an enlarged view of FIG. 1B.
Figure 2:
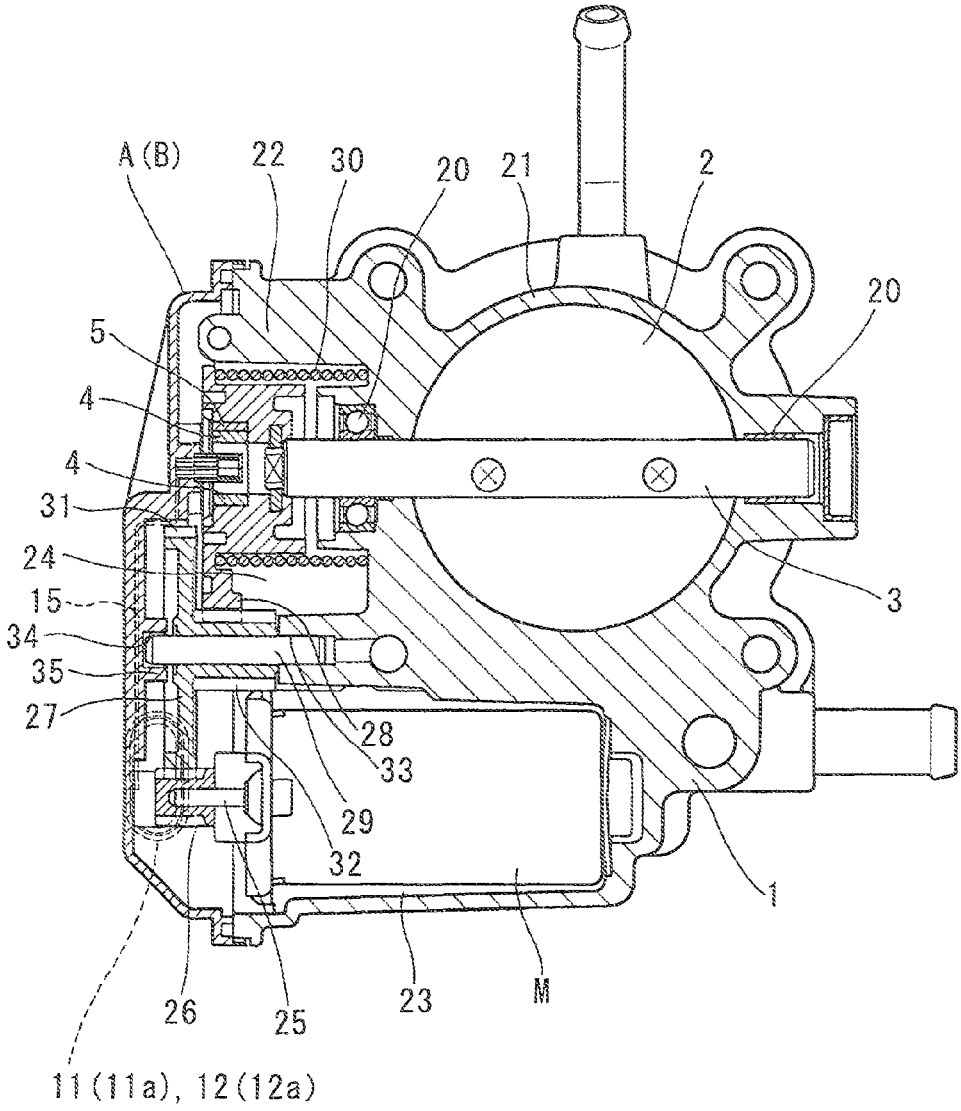
FIG. 2 is a cross-sectional view illustrating an electronic throttle device including a sensor module in accordance with the first embodiment.
Figure 3:
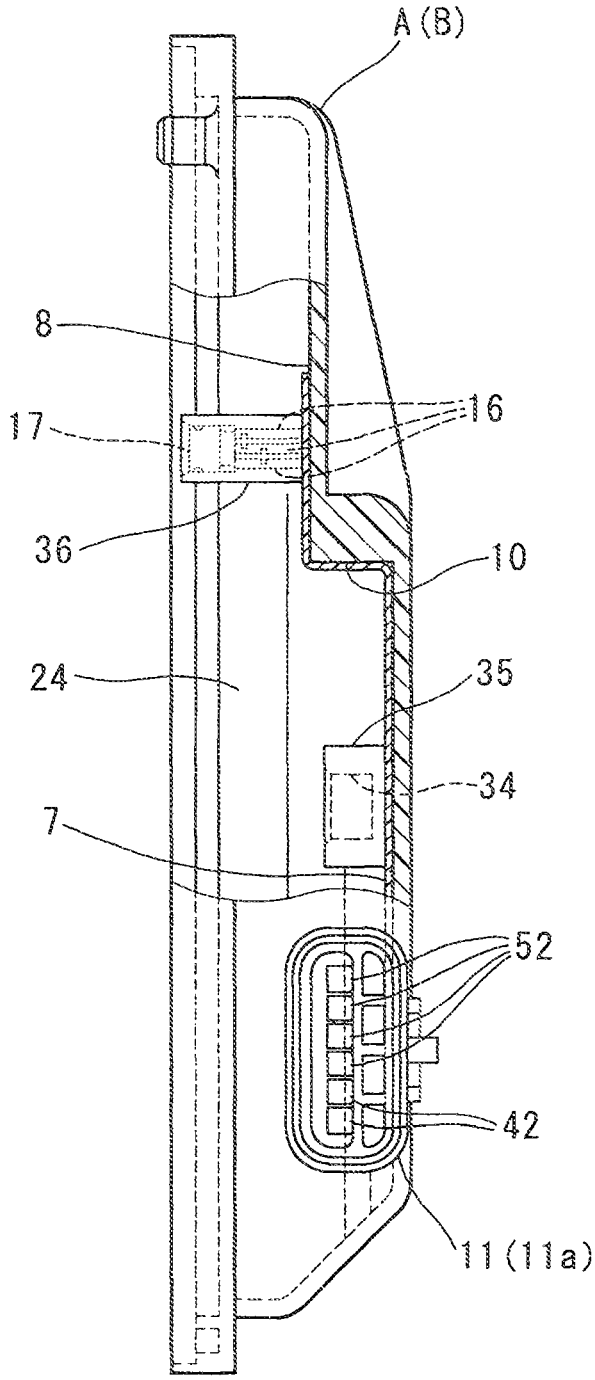
FIG. 3 is a sectional view illustrating a motor wiring unit and a sensor wiring unit held by the first module cover in accordance with the first embodiment.
Figure 4:
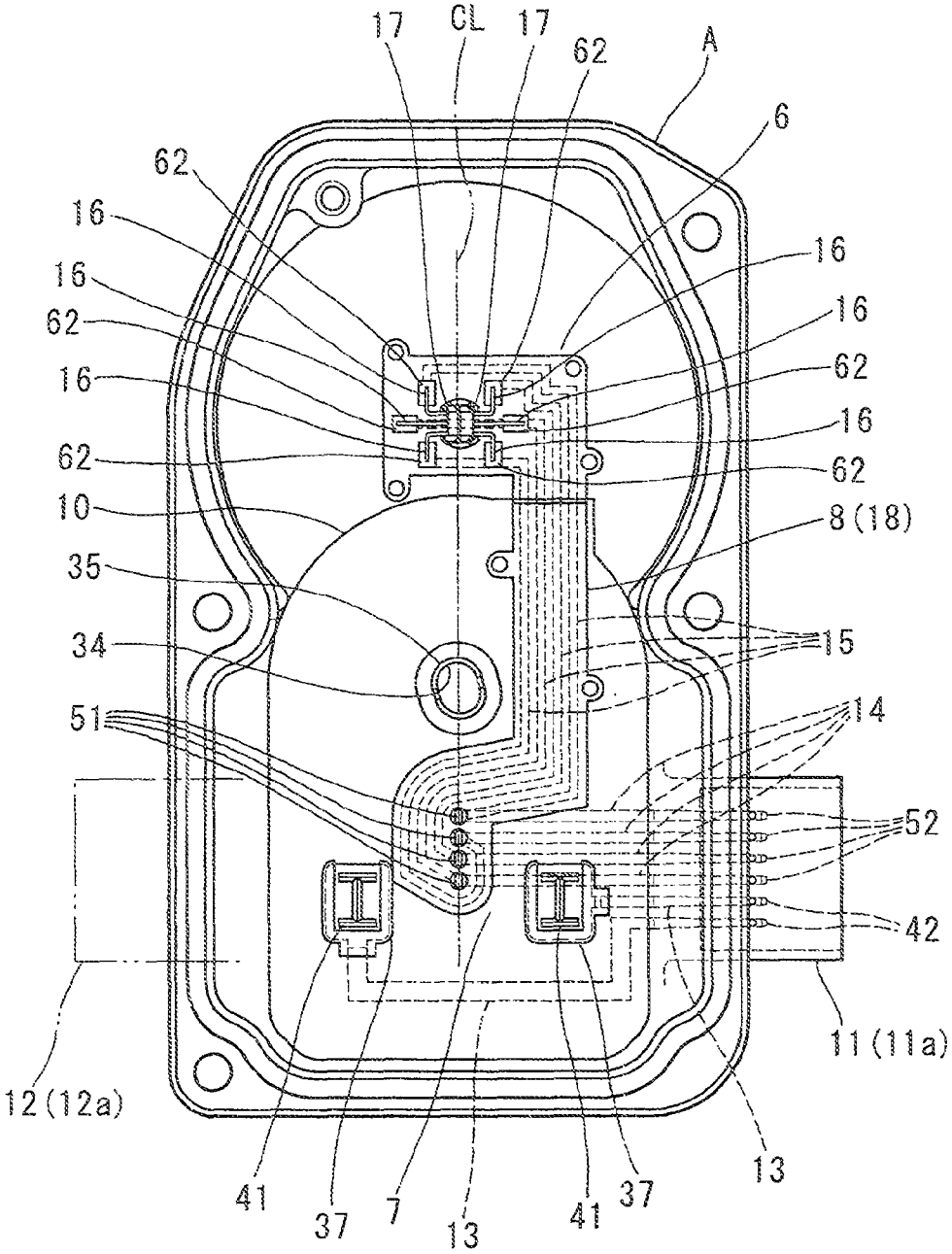
FIG. 4 is a plan view illustrating the motor wiring unit and the sensor wiring unit held by the first module cover in accordance with the first embodiment.
Figure 5:
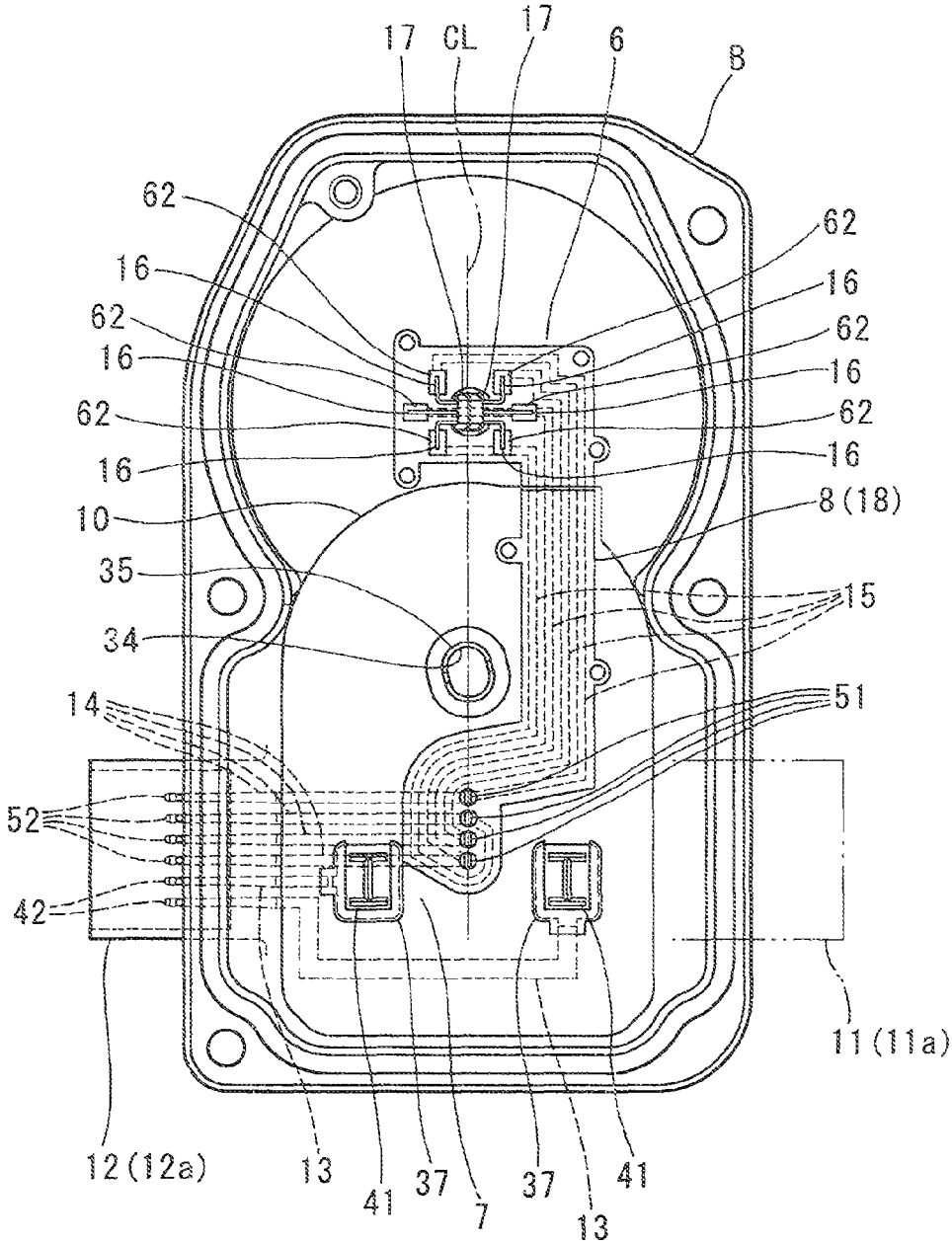
FIG. 5 is a plan view illustrating the motor wiring unit and the sensor wiring unit held by the second module cover in accordance with the first embodiment.

Configuration of a first embodiment of the invention will be described in reference to FIGS. 1A to 5. FIGS. 1A to 1C illustrate a motor wiring unit and a sensor wiring unit held by a first module cover (second module cover).

An electronic throttle device of the present embodiment includes a throttle body 1 that is incorporated in an intake pipe of an engine, a throttle valve 2 that adjusts a flow rate of intake air, which flows through a throttle bore of this throttle body 1, by its opening and closing operations, an electric actuator that rotates a shaft 3, which supports and fixes this throttle valve 2, to open or close the throttle valve 2, and a rotation angle detecting unit that detects a rotation angle of the shaft 3 of the throttle valve 2. The electronic throttle device is used as an intake control device for the engine that controls intake air supplied into a combustion chamber for each cylinder of the engine.

The rotation angle detecting unit includes a magnet rotor (a pair of magnets 4 and a yoke 5) that rotates in synchronization with the shaft 3 of the throttle valve 2, and a throttle opening degree sensor module (hereinafter referred to as a sensor module) that measures a rotation angle of this magnet rotor to detect a throttle opening degree corresponding to the rotation angle of the throttle valve 2. The sensor module includes a sensor unit mounted, and has two module covers A, B having different shapes.

The sensor unit for common use, is held and fixed to sensor mounting portions 6 of the module covers A, B. The motor wiring unit and the sensor wiring unit are held and fixed to terminal wiring parts 7 of the module covers A, B. A flexible wiring substrate 8 is arranged on inner surfaces of the module covers A, B along the inner surface shapes of the module covers A, B from the sensor mounting portion 6 to the terminal wiring part 7. A connector 11 for an electrical connection between an electric motor M and the sensor unit, and an external circuit is disposed integrally with the module cover A. A connector 12 for an electrical connection between the electric motor M and the sensor unit, and the external circuit is disposed integrally with the module cover B.

The motor wiring unit includes a motor terminal conductor group (a pair of first and second motor terminals 13) extending from the connectors 11, 12 to the vicinity of the electric motor M. The sensor wiring unit includes a sensor terminal conductor group (first to fourth sensor terminals 14) extending from the connectors 11, 12 to a central part of the terminal wiring part 7 in its width direction (central part in a cover width direction), and the flexible wiring substrate 8 extending from the central part of the terminal wiring part 7 in the cover width direction to the sensor mounting portion 6, particularly, to the vicinity of the sensor unit.

The flexible wiring substrate 8 includes a base film made of an insulating resin material having flexibility. First to fourth wiring conductor patterns 15, which make a transit connection between the sensor unit and the first to fourth sensor terminals 14, are formed on a surface of this base film. The sensor unit includes two first and second semiconductor Hall elements that output an electrical signal corresponding to the opening degree of the throttle valve 2 which is a measuring object (rotation information such as a rotation angle and rotation direction) to an external electronic control unit (ECU), and first to sixth sensor leads 16 that are conduction-joined to these first and second semiconductor Hall elements. Details of the module covers A, B, the connectors 11, 12, the motor wiring unit, the sensor unit, and the sensor wiring unit will be described hereinafter.

A multi-cylinder gasoline engine having the cylinders is employed for the engine. The intake pipe and an exhaust pipe are connected to this engine. A cylindrical bearing holding portion (cylindrical portion) that surrounds a bearing portion (bearing 20), which supports the shaft 3 slidably in its rotation direction, in the circumferential direction, is provided for the throttle body 1, which accommodates the throttle valve 2 in an openable and closable manner. Bearing holes extending in a rotation shaft direction of the shaft 3 are formed inside the cylindrical portions.

A cylindrical intake duct (throttle bore wall portion) 21 incorporated along the engine intake pipe, and a gear housing 22 accommodating the electric actuator therein, are formed integrally with the throttle body 1. A throttle bore (engine intake passage) having a circular shape in cross-section that communicates with the combustion chamber for each cylinder of the engine is formed inside the intake duct 21. The gear housing 22 includes a cylindrical gear accommodating recess having a bottom part that opens on its module cover (covering member) A, B-side. The module covers A, B covering the opening of the gear housing 22 are joined to a joined portion of the peripheral wall of this gear housing 22. A motor accommodating space 23 and a gear accommodating space 24 are formed in the gear accommodating recess of the gear housing 22.

The throttle valve 2 is fastened and fixed to the shaft 3 by a fastening screw with the valve 2 inserted in a valve insertion hole formed on the shaft 3. Accordingly, the throttle valve 2 is coupled to the shaft 3 rotatably together with the shaft 3. The shaft 3 is driven in the rotation direction by the electric actuator that includes the electric motor M and a deceleration mechanism (three reduction gears 26 to 28, and an intermediate gear shaft 29). The axis of rotation of this shaft 3 serves as the rotation center of the throttle valve 2. The shaft 3 is supported rotatably by the bearing holding portion of the throttle body 1 through the bearing portion (bearing 20).

The electric actuator is used as a valve drive unit that opens and closes the throttle valve 2. This electric actuator includes the electric motor M that drives the throttle valve 2 in a valve opening direction or valve closing direction, the deceleration mechanism that decelerates the rotation of this electric motor M in two stages to transmit it to the shaft 3, and a coiled return spring (valve urging means) 30 that urges the throttle valve 2 in its valve closing direction or valve opening direction. The electric motor M is accommodated and held in the motor accommodating space 23 of the gear housing 22. The deceleration mechanism includes the three reduction gears 26 to 28 that rotate in synchronization with a motor shaft (motor output shaft) 25 of the electric motor M.

The deceleration mechanism includes the pinion gear (motor gear) 26 that is press-fitted and fixed around an outer circumference of the motor shaft 25, the intermediate gear 27 that rotates in engagement with this pinion gear 26, and the final gear (throttle valve gear) 28 that rotates in engagement with this intermediate gear 27. The deceleration mechanism includes an intermediate gear shaft (support shaft) 29 arranged in parallel with the shaft 3 and the motor shaft 25. The three reduction gears 26 to 28 are accommodated rotatably in the gear accommodating space 24 of the gear housing 22.

The intermediate gear 27 is rotatably fitted around an outer circumference of the intermediate gear shaft 29. Projecting gear teeth (major diameter gear portion) 31 that are engaged with the pinion gear 26, and projecting gear teeth (minor diameter gear portion) 32 that are engaged with the final gear 28 are formed on an outer circumference of this intermediate gear 27. The final gear 28 is configured by integral molding using a mold resin material having insulation properties. In other words, the final gear 28 is integrally formed from the mold resin material. This final gear 28 is fixed to one end part of the shaft 3 in its rotation axis direction (left end portion in FIG. 2) in a rotation-stop state.

The final gear 28 includes a cylindrical portion that is disposed to surround the shaft 3 in the circumferential direction. An outer circumference of this cylindrical portion includes a maximum outer diameter portion (larger diameter portion) that is formed in fan-like fashion by a predetermined rotation angle. The magnet rotor, i.e., the pair of magnets 4 and the yoke 5, is inserted in the inner circumferential portion of the final gear 28. The axis line of the intermediate gear shaft 29 serves as the rotation center of the intermediate gear 27. One end side of this intermediate gear shaft 29 is driven and fixed in a fitting hole 33 of the gear housing 22. The other end side of the intermediate gear shaft 29 is inserted in a fitting hole 34 of the module covers A, B to be fitted in a cylindrical boss portion 35 of the module covers A, B.

The electric motor M is a power source which generates driving force (torque) upon supply of electric power. The electric motor M is electrically connected to a battery (external power) mounted in a vehicle such as an automobile through a motor drive circuit that is electronically controlled by an engine control unit (ECU). A microcomputer having a widely-known configuration that includes functions of, for example, a central processing unit (CPU) that performs control processing and arithmetic processing, a storage device (memory such as a read-only memory (ROM) and a random access memory (RAM)) that stores a control program or control logic and various data, an input circuit (input part), an output circuit (output part), a power supply circuit, and a timer, is provided for the ECU.

The ECU is configured such that sensor output signals from various sensors such as the sensor unit, an air flow meter, a crank angle sensor, an accelerator opening degree sensor, a coolant temperature sensor, and an intake pressure sensor are inputted into the microcomputer after they are analog-digital converted through an analog-digital (A/D) converter. An operational state detection means for detecting an operation condition (operational state) of the engine is constituted of these sensor unit, air flow meter, crank angle sensor, accelerator opening degree sensor, coolant temperature sensor, and intake pressure sensor, for example. The sensor output signal from various sensors are read in repeatedly for each control period of the control program or control logic stored in the memory of the microcomputer.

The microcomputer includes a sensor output signal detection circuit (sensor output voltage detection circuit) that detects the sensor output signal (throttle opening degree signal, sensor output voltage: Vout) outputted from the throttle opening degree sensor, and a sensor output signal processing circuit which specifies the actual throttle opening degree based on the sensor output voltage (Vout) detected by this sensor output signal detection circuit. The microcomputer calculates a target throttle opening degree based on the sensor output signal (accelerator opening degree signal) outputted from the accelerator opening degree sensor. The microcomputer feedback-controls the power supply to the electric motor M such that the actual throttle opening degree coincides with the target throttle opening degree, thereby to control the throttle opening degree.

The sensor module is used for the throttle opening degree sensor that measures the rotation angle of the magnet rotor to detect the throttle opening degree corresponding to the rotation angle of the throttle valve 2. As described above, the sensor module includes the module covers A, B, the connectors 11, 12, the sensor unit, the motor wiring unit, and the sensor wiring unit. The magnet rotor is coupled with the throttle valve 2 rotatably together with the valve 2. Specifically, the magnet rotor (the pair of magnets 4 and the yoke 5) is fixed to the inner circumferential portion of the final gear 28, which is fixed to one end part of the shaft 3 of the throttle valve 2 in its rotation axis direction through insert molding.

The magnet rotor includes the pair of magnets 4 that give magnetic flux to the sensor unit, and the yoke 5 that concentrates the magnetic flux (magnetic field) released from this magnet 4 on the sensor unit. The pair of magnets 4 is integrated (fixed) to the inner circumferential portion of the final gear 28 of the deceleration mechanism together with the yoke 5 by insert molding. These magnets 4 are permanent magnets (ferrite magnets) which release the magnetic flux (magnetic field) toward the sensor unit. The yoke 5 is formed from a magnetic material (magnetic body) having magnetism, such as iron, nickel, ferrite that constitutes a closed magnetic circuit.

The pair of magnets 4 are parallel-magnetized such that directions of lines of magnetic forces in the magnets are parallel to each other. The pair of magnets 4 are arranged to be opposed to each other with the central line of the shaft 3 of the throttle valve 2 in its rotation axis direction therebetween. The polarity of a pole face formed on a radially-inward (inner circumferential side) end face of one magnet 4 of the pair of magnets 4 is an N-pole. The polarity of a pole face formed on a radially-outward (outer circumferential side) end face of one magnet 4 of the pair of magnets 4 is an S-pole. The polarity of a pole face formed on a inner-circumferential side end face of the other magnet 4 of the pair of magnets 4 is an S-pole. The polarity of a pole face formed on a outer-circumferential side end face of the other magnet 4 of the pair of magnets 4 is an N-pole.

The sensor unit includes the two first and second semiconductor Hall elements, which are noncontact-type magnetism detecting elements that detect the magnetic flux (magnetic flux density, magnetic field distribution, magnetic field strength) changing in accordance with the movement of the magnet rotor (the pair of magnets 4 and the yoke 5) in its rotation direction. Magnetism sensing surfaces that sense magnetic flux density (amount of magnetic flux) and magnetic field strength of the magnetic field applied by the pole face of the magnet rotor, particularly, the pair of magnets 4, are provided for these first and second semiconductor Hall elements. The sensor unit is disposed to project from the sensor mounting portion 6 of the two module covers A, B toward the bottom face of the gear accommodating recess of the gear housing 22. This sensor unit mainly includes two first and second Hall ICs that output to the ECU, electrical signals (voltage signal, sensor output signal: hereinafter referred to as a sensor output value) corresponding to the magnetic flux density that interlinks with the magnetism sensing surfaces of the first and second semiconductor Hall elements.

The first Hall IC-side sensor unit includes the first semiconductor Hall element that outputs an electrical signal (output voltage) which is in proportion to the density of magnetic flux released from the pole face of the pair of magnets 4, and a first sensor chip (Hall element chip) that has a first voltage amplifier which outputs an amplified signal of each output voltage of this first semiconductor Hall element; a first lead frame that is conduction-joined to an electrode pad portion of this first sensor chip; and a resin package 17 that resin-seals the first sensor chip and the first lead frame with, for example, a mold resin material (sealing agent) having insulation properties. The first sensor chip is mounted on a surface of the first lead frame through an insulating resin material.

Similar to the first Hall IC-side sensor unit, the second Hall IC-side sensor unit includes a second sensor chip (Hall element chip) that includes a second semiconductor Hall element and a second voltage amplifier, a second lead frame, and a resin package 17. Similar to the first sensor chip, the second sensor chip is mounted on a surface of the second lead frame through an insulating resin material. As described above, the two first and second Hall ICs are IC chips (sensor chips) obtained by integrating respective first and second semiconductor Hall elements and respective first and second voltage amplifiers. A magnetism detecting element such as a semiconductor Hall element alone or a magnetoresistive element (MR element) may be used instead of the Hall IC.

The two first and second lead frames are formed from a metal material which has conductivity such as copper alloy. These first and second lead frames include inner leads whose respective conduction joining portions to the first and second sensor chips are resin-sealed with a mold resin material. The two first and second lead frames include outer leads whose conduction joining portions with the first to fourth wiring conductor patterns 15 of the flexible wiring substrate 8 project from the side surface toward the exterior (outer side) of the mold resin material to be exposed to the exterior of the mold resin material. In the present embodiment, respective outer leads of the two first and second lead frames are used for the first to sixth sensor leads 16. The first to sixth sensor leads 16 extend to project from the side surface toward the exterior (outer side) of the mold resin material.

The first and second sensor leads 16 of the first to sixth sensor leads 16 serve as respective signal output-side sensor lead wires of the first and second Hall ICs. The third and fourth sensor leads 16 of the first to sixth sensor leads 16 serve as respective external power (VCC) side-sensor lead wires of the first and second Hall ICs. The fifth and sixth sensor leads 16 of the first to sixth sensor leads 16 serve as respective ground (GND) side-sensor lead wires of the first and second Hall ICs. The first to sixth sensor leads 16 serve as a third connecting terminal (sensor lead terminal) that projects and is exposed, from surfaces (side surfaces) to the exterior (outer side) of the respective resin packages 17. These first to sixth sensor leads 16 are conduction-joined (soldered) to an electrode pad portion (fourth connecting terminal) of the flexible wiring substrate 8 through a solder material. First and second semiconductor devices (such as capacitor) for protecting the two first and second Hall ICs from a disturbance surge such as static electricity or lightning may be provided, in addition to the two first and second semiconductor Hall elements, for a magnetism detection circuit that is constituted of the two first and second Hall ICs and the first and second lead frames. Moreover, the sensor unit may be constituted of one or more than two Hall ICs.

The two module covers A, B having different shapes include cylindrical gear accommodating recesses with bottom parts that open on their gear housing 22-sides. These module covers A, B are selected according to, for example, types of automobiles or constraints on their installation positions, and attached to the gear housing 22 of the throttle body 1. The sensor unit, the flexible wiring substrate 8, the first and second motor terminals 13, and the first to fourth sensor terminals 14, which are held by the module covers A, B, are used in common. The module covers A, B include cylindrical gear accommodating recesses with bottom parts that open on their gear housing 22-sides.

The module cover A of the module covers A, B is formed integrally using a mold resin material having insulation properties. This module cover A is a covering member (cover body) that defines the motor accommodating space 23 between the cover A and the gear housing 22 of the throttle body 1 and closes an opening of the gear housing 22. The module cover A includes a side wall (peripheral wall) that surrounds the motor accommodating space 23 in the circumferential direction. This side wall includes a fitted part that is fitted to the joined portion of the gear housing 22 formed on its opening side, and is fastened and fixed to the joined portion of the gear housing 22 by a fastening bolt.

The module cover A includes the connector 11 that makes an electrical connection between the sensor unit mainly including the two first and second Hall ICs and the electric motor M, and the outside (the ECU and the battery), the sensor mounting portion 6 holding the sensor unit, the terminal wiring part 7 that is wired by the motor wiring unit and the sensor wiring unit, and a level difference 10 formed between the sensor mounting portion 6 and the terminal wiring part 7. A sensor holder 36, which supports the resin package 17 of the sensor unit, is attached to the sensor mounting portion 6.

The size of the module cover A in its longitudinal direction is longer than the size of the cover A in its width direction (shorter direction of the module cover A) that is perpendicular to the central line of the module cover A in its longitudinal direction. The sensor mounting portion 6 and the terminal wiring part 7 are configured (formed) respectively on both end sides of the module cover A in its longitudinal direction with a predetermined distance therebetween. The module cover B is configured by integral molding using a mold resin material having insulation properties. Similar to the module cover A, this module cover B includes the sensor mounting portion 6, the terminal wiring part 7, and the level difference 10.

The two module covers A, B include a first side wall (right-side wall in FIG. 1A) on one side (right-hand side in FIG. 1A) of the terminal wiring part 7 in the cover width direction, and include a second side wall (left-side wall in FIG. 1A) on the other side (left-hand side in FIG. 1A) of the terminal wiring part 7 in the cover width direction. The first side wall is formed to be opposed to the second wide wall with a predetermined distance between the first side wall and the second side wall. The connector (first connector) 11, which makes an electrical connection between the motor wiring unit and the sensor wiring unit, and the outside (the ECU and the external power), is disposed integrally with the module cover A. This connector 11 includes an angulate cylindrical housing 11*a* extending from an outer surface of the first side wall of the module cover A toward the exterior (outside, the direction of fitting to another connector (connector connecting direction)). The direction of fitting of the housing 11*a* of the connector 11 to another connector (connector connecting direction) faces rightward in FIG. 1A, i.e., the connector 11 faces rightward in FIG. 1A.

The connector (second connector) 12, which makes an electrical connection between the motor wiring unit and the sensor wiring unit, and the outside (the ECU and the external power), is disposed integrally with the module cover B. This connector 12 includes an angulate cylindrical housing 12*a* extending from an outer surface of the second side wall of the module cover B toward the exterior (outside, the direction of fitting to another connector (connector connecting direction)).

The direction of fitting of the housing 12*a* of the connector 12 to another connector (connector connecting direction) faces leftward in FIG. 1A, i.e., the connector 12 faces leftward in FIG. 1A. Accordingly, the two module covers A, B have such plane-symmetrical shapes that the directions of fitting of the connectors 11, 12 to another connector (connector connecting direction) are reversed by 180 degrees relative to each other and face in the opposite directions, with a plane that passes through the central part of the terminal wiring part 7 of the connectors 11, 12 in its width direction and that includes the central line of the connectors 11, 12 in their longitudinal direction serving as a symmetry plane. Therefore, the two module covers A, B have module cover shapes of such a type that the directions of the connectors 11, 12 are reversed.

The sensor wiring unit includes the pair of first and second motor terminals 13 extending on the respective terminal wiring parts 7 of the module covers A, B in the cover width direction. The first and second motor terminals 13 are metallic conductor plates (third wiring member) such as copper alloy or aluminum alloy. The first and second motor terminals 13 are a pair of positive and negative electrode connector terminals fixed (embedded and held) into the respective terminal wiring parts 7 of the module covers A, B through their insertion using a mold resin material.

A pair of motor connecting terminals 41 which are which are conduction-joined to positive and negative electrode terminals (not shown) of the electric motor M, are formed integrally with one end sides of the first and second motor terminals 13. The pair of motor connecting terminals 41 include exposed portions that project and are exposed from a surface (inner surface of the terminal wiring part 7) of the mold resin material toward the electric motor M at terminal holders 37 disposed near the electric motor M. A pair of motor connector terminals 42 that make an electrical connection between the electric motor M and the ECU, the motor drive circuit, or the battery, are integrally formed on the other end sides of the first and second motor terminals 13, i.e., on the opposite side from the motor connecting terminal. The pair of motor connector terminals 42 include exposed portions that project and are exposed from the mold resin material into internal spaces of the housings 11*a*, 12*a*.

The sensor wiring unit is divided between the flexible wiring substrate 8 which has flexibility, and the first to fourth sensor terminals 14. The first to fourth sensor terminals 14 are metallic conductor plates such as copper alloy or aluminum alloy. These first to fourth sensor terminals 14 are produced by performing punching shape-forming on a metallic thin plate which has conductivity by a press-forming machine, and by bending the plate at a predetermined region at the same time as this punch forming or after the punch forming.

The first to fourth sensor terminals 14 are connecting members extending from the connectors 11, 12 to the central part in the case width direction (central part of the terminal wiring part 7 in its width direction) that is perpendicular to the central line (CL) of the module covers A, B in their longitudinal direction. The first to fourth sensor terminals 14 are extended in the cover width direction of the respective terminal wiring parts 7 of the module covers A, B. The first to fourth sensor terminals 14 are more than one (four in the present embodiment) first to fourth connector terminals configured in the respective terminal wiring parts 7 of the module covers A, B through integral molding using a mold resin material. Specifically, the first to fourth sensor terminals 14 are fixed (embedded and held) in the mold resin material constituting the module covers A, B by insert molding.

Sensor connecting terminals (first connecting terminals) 51 which are conduction-joined to the first to fourth wiring conductor patterns 15 of the flexible wiring substrate 8 are integrally formed on one end sides of the first to fourth sensor terminals 14. The sensor connecting terminals 51 include exposed portions that project and are exposed from the surface of the mold resin material (inner surface of the terminal wiring part 7) toward the bottom face of the gear housing 22 at the central part of the module covers A, B in the cover width direction. The sensor connecting terminals 51 are bent in a direction that is perpendicular to the formation direction of a terminal insertion (embedded portion) inserted into the mold resin material, to pass through a through hole of the flexible wiring substrate 8.

Sensor connector terminals 52 that make an electrical connection between the sensor unit and the ECU or the battery are integrally formed on the other end sides of the first to fourth sensor terminals 14, i.e., on the opposite side from the sensor connecting terminal. The sensor connector terminals 52 include exposed portions that project and are exposed from the mold resin material into internal spaces of the housings 11*a*, 12*a*. The sensor connector terminals 52 are arranged in parallel with the pair of motor connector terminals 42.

The flexible wiring substrate 8 includes a base film that is integrally formed from a resin material having insulation properties, the first to fourth wiring conductor patterns 15 that are formed on a surface of this base film, and an insulating film 18 that is formed to cover these first to fourth wiring conductor patterns 15. Specifically, a metallic foil such as copper is formed on a surface of a synthetic resin film (base film) formed from polyethylene terephthalate (PET) or polyimide (PI), for example. Then, this metallic foil is etched in a predetermined shape to form a wiring conductor pattern. Alternatively, wiring conductor ink is printed on the surface of the base film to form a wiring conductor pattern.

The flexible wiring substrate 8 extends in the longitudinal direction of the module covers A, B. The flexible wiring substrate 8 is arranged in a beltlike manner over a range from the respective terminal wiring parts 7 of the module covers A, B via the level difference 10 to the sensor mounting portion 6. The flexible wiring substrate 8 of the present embodiment is held on the inner surfaces of the module covers A, B along the inner surface shapes of the module covers A, B having the level difference 10. Accordingly, the substrate 8 is bent at a right angle at two points corresponding to the level difference 10. The flexible wiring substrate 8 is wired (arranged) around an obstruction (cylindrical boss portion 35) formed on the inner surface of the respective terminal wiring parts 7 of the module covers A, B.

Fitting pins 53, 54 that project and extend from the surface (inner surfaces of the module covers A, B; bottom face of the gear accommodating recess) of the mold resin material toward the bottom face of the gear housing 22 are formed integrally with the respective sensor mounting portions 6 and the respective terminal wiring parts 7 of the module covers A, B of the present embodiment. Fitting holes through, which the fitting pins 53, 54 respectively pass, are formed in the flexible wiring substrate 8. Front end sides of the fitting pins 53, 54 in their axial directions are crushed by heat calking, for example, after they pass through the fitting holes to project from the surface of the flexible wiring substrate 8. Accordingly, the flexible wiring substrate 8 is held and fixed by the module covers A, B on the inner surfaces of the module covers A, B (bottom face of the gear accommodating recess). In the present embodiment, although the flexible wiring substrate 8 having the one-sided configuration is employed, a flexible wiring substrate having a both-sided configuration may be used.

Through holes, which open at the central part of the respective terminal wiring parts 7 of the module covers A, B in the case width direction, are formed in the base film of the flexible wiring substrate 8. First to fourth openings (terminal side openings) having a circular (or rectangular) shape are formed on the insulating film 18 of the flexible wiring substrate 8 at the portions corresponding to each through hole of the base film and respective electrode pads 61 of the first to fourth wiring conductor patterns 15. The respective electrode pads 61 of the first to fourth wiring conductor patterns 15 serve as a conduction joining portion (second connecting terminal) that is conduction-joined (soldered) via a solder material to the respective sensor connecting terminals 51 of the first to fourth sensor terminals 14, which are exposed from the insulating film 18 at the central part of the module covers A, B in the cover width direction and pass through the through holes and the respective electrode pads 61 to project therefrom.

First to fourth openings (sensor unit side openings) having a rectangular shape are formed on the insulating film 18 of the flexible wiring substrate 8 at the portions corresponding to electrode pads 62 of the first to fourth wiring conductor patterns 15. The respective electrode pads 62 of the first to fourth wiring conductor patterns 15 are exposed from the insulating film 18 near the sensor unit, and serve as a conduction joining portion (fourth connecting terminal) that is conduction-joined (soldered) via a solder material to the first to sixth sensor leads 16 of the sensor unit.

The first and second wiring conductor patterns 15 of the first to fourth wiring conductor patterns 15 are relay wiring members that make a relay-connection between the first and second sensor terminals 14 of the connectors 11, 12 and the first and second sensor leads 16 of the sensor unit. The third wiring conductor pattern 15 of the first to fourth wiring conductor patterns 15 is a relay wiring member that makes a relay connection between the third sensor terminal 14 of the connectors 11, 12 and the third and fourth sensor leads 16 of the sensor unit. The fourth wiring conductor pattern 15 of the first to fourth wiring conductor patterns 15 is a relay wiring member that makes a relay connection between the fourth sensor terminal 14 of the connectors 11, 12 and the fifth and sixth sensor leads 16 of the sensor unit. The resin package 17 that accommodates the first and second Hall ICs of the sensor unit, the respective sensor connecting terminals 51 of the first to fourth sensor terminals 14, and the respective electrode pads 61 of the first to fourth wiring conductor patterns 15 are disposed on the central line (CL) of the module covers A, B in their longitudinal direction.

Workings of the first embodiment will be described. The operation of the electronic throttle device of the present embodiment will be briefly described below with reference to FIGS. 1A to 5.

When an ignition key switch is turned on, i.e., when an ignition switch is turned on (IG-ON), the ECU energization-controls the electric motor M of the electronic throttle device (e.g., throttle valve 2), and drives an ignition device (e.g., ignition coil, spark plug) and a fuel injection system (e.g., electric fuel pump, injector). As a result, the engine is operated.

When a driver depresses an accelerator pedal, the accelerator opening degree signal outputted from the accelerator opening degree sensor is inputted into the ECU. Then, the electric power is supplied to the electric motor M by the ECU thereby to rotate the motor shaft 25 of the electric motor M, such that the throttle valve 2 has a predetermined throttle opening degree (rotation angle). As a result of the rotation of the motor shaft 25, the pinion gear 26 rotates to transmit motor torque to the major diameter gear portion 31 of the intermediate gear 27.

When the minor diameter gear portion 32 rotates in accordance with the rotation of the intermediate gear 27, the final gear 28, which is in engagement with the minor diameter gear portion 32, is rotated. Accordingly, in accordance with the rotation of the final gear 28, the shaft 3, to which the final gear 28 is fixed, rotates by a rotation angle corresponding to the depression amount of the accelerator pedal (accelerator operation amount) against the spring force of the return spring 30. As a result, the shaft 3 rotates, and the throttle valve 2 held by this shaft 3 is thereby driven in a direction (valve opening operation direction) in which the valve 2 opens from its fully closed position toward its fully open position.

When a particular cylinder of the engine changes from an exhaust stroke to an intake stroke in which an intake valve is opened and a piston moves down, a negative pressure (pressure lower than the atmospheric pressure) in a combustion chamber of this cylinder becomes larger in accordance with the descent of the piston, and the air-fuel mixture is thereby drawn through the opened intake port. Meanwhile, the halfway portion of an air intake duct, i.e., the throttle bore of the throttle body 2 is opened by a predetermined valve angle (throttle opening degree of the electronic throttle device). Consequently, the engine rotation speed is changed to a speed corresponding to the depression amount of the accelerator pedal (accelerator operation amount).

The rotation angle detecting unit including the sensor module detects the positions of the shaft 3 of the throttle valve 2 and the magnet rotor (the pair of magnets 4 and the yoke 5) that rotates together with the final gear 28 by the two first and second Hall ICs (sensor unit). The detecting unit sends the sensor output signal (voltage signal, throttle opening degree signal) to the ECU, via the respective first to sixth sensor leads 16 of the two first and second lead frames, the respective first to fourth wiring conductor patterns 15 of the flexible wiring substrate 8, and the first to fourth sensor terminals 14 of the connectors 11, 12. Based on this sensor output signal, the ECU calculates the amount of fuel injected from the injector.

Advantageous effects of the first embodiment will be described. In the sensor module incorporated into the electronic throttle device of the present embodiment, for the module cover having the sensor mounting portion 6 and the terminal wiring part 7, the two module covers A, B having different shapes are produced in view of the constraints on the installation position. Two motor terminal conductor groups having the same shape are produced for the first and second motor terminals 13. Four sensor terminal conductor groups having the same shape are produced for the first to fourth sensor terminals 14.

The connectors 11, 12 including the housings 11*a*, 12*a*, the first and second motor terminals 13, and the first to fourth sensor terminals 14 are integrally provided respectively for the two module covers A, B. As illustrated in FIGS. 1A to 1C, 4, and 5, the two module covers A, B has such plane-symmetrical shapes that the directions of fitting of the connectors 11, 12 to another connector (connector connecting direction) are reversed by 180 degrees relative to each other and face in the opposite directions, with the plane that passes through the central part of the respective terminal wiring parts 7 of the module covers A, B in the cover width direction and that includes the central line (CL) of the module covers A, B in the cover longitudinal direction serving as a symmetry plane. Thus, the connector 11 of the module cover A is reversed by 180 degrees and faces in the opposite direction relative to the direction of the connector 12 of the module cover B.

Similar to the connectors 11, 12, the first and second motor terminals 13 which are insert-molded in the respective terminal wiring parts 7 of the module covers A, B have such plane-symmetrical shapes as to be reversed by 180 degrees relative to each other and face in the opposite directions, with the plane that passes through the central part of the respective terminal wiring parts 7 of the module covers A, B in the cover width direction and that includes the central line (CL) of the module covers A, B in the cover longitudinal direction serving as a symmetry plane. Therefore, the first and second motor terminals 13 can be used in common for the covers A, B by turning over the front and rear surfaces of both the first and second motor terminals 13 so as to correspond to the shapes of the module covers A, B.

The first to fourth sensor terminals 14 which are insert-molded in the respective terminal wiring parts 7 of the module covers A, B have rotational symmetry shapes with the central axes of the central parts of the module covers A, B in the cover width direction serving as the symmetry center. Therefore, the first to fourth sensor terminals 14 of the module cover A have a rotational symmetry shape such that the terminals 14 of the cover A overlap with the first to fourth sensor terminals 14 of the module cover B if the terminals 14 of the cover A are rotated by a predetermined angle (e.g., 180 degrees) with an imaginary central axis at the central part of the module covers A, B in the width direction serving as the symmetry center.

As described above, in the sensor module of the electronic throttle device of the present embodiment, the respective sensor connecting terminals 51 of the first to fourth sensor terminals 14 are exposed from a surface of the mold resin material at the central part of the module covers A, B in the width direction so that the respective sensor connecting terminals 51 of the first to fourth sensor terminals 14 and the respective electrode pads 61 of the first to fourth wiring conductor patterns 15 can be conduction-joined together. Accordingly, the first to fourth sensor terminals 14 can be used for the module cover shape of the type of the reversed directions of the connectors 11, 12 by rotating them by a predetermined angle (e.g., 180 degrees) with the imaginary central axis at the central part of the module covers A, B in the width direction serving as the center. Consequently, even in the case in which the module cover B having a different shape from the currently-used module cover A is produced, the increase of production costs due to the new provision of the first and second motor terminals 13 and the first to fourth sensor terminals 14 can be prevented.

The first to fourth sensor terminals 14 are held in the respective terminal wiring parts 7 of the module covers A, B by insert-molding using the mold resin material; and the terminals 51 are exposed from the surface of the mold resin material at the central part of the module covers A, B in the cover width direction so that the respective sensor connecting terminals 51 of the first to fourth sensor terminals 14 can be conduction-joined to the respective electrode pads 61 of the first to fourth wiring conductor patterns 15. As a result, the sensor wiring unit (first to fourth sensor terminals 14) from the connectors 11, 12 to the sensor connecting terminal 51; and the sensor wiring unit (first to fourth wiring conductor patterns 15) from the electrode pads 61, which are conduction-joined to the respective sensor connecting terminals 51 of the first to fourth sensor terminals 14 to the vicinity of the sensor unit can be separately configured. Thus, the first to fourth wiring conductor patterns 15 from the respective electrode pads 61 of the first to fourth wiring conductor patterns 15 to the vicinity of the sensor unit can be two-level crossed relative to the first to fourth sensor terminals 14. Therefore, a degree of flexibility in wiring of the sensor wiring unit (particularly, the first to fourth wiring conductor patterns 15) can be improved.

The sensor wiring unit from the connectors 11, 12 to the sensor unit is divided into the first to fourth sensor terminals 14 and the first to fourth wiring conductor patterns 15. Accordingly, the lengths of the first to fourth sensor terminals 14 alone, i.e., the first to fourth sensor terminals 14 formed integrally with the mold resin material constituting the module covers A, B are shortened. Thus, the first to fourth sensor terminals 14 are not deformed at the time of their integral-molding with the module covers A, B, and the size of the sensor module is standardized to reduce its level of defectiveness. As a result, the productivity of the sensor module can be improved.

The module covers A, B, which have the level difference 10 between the sensor mounting portion 6 and the terminal wiring part 7, are employed as the module cover components. Accordingly, despite the module covers A, B having the level differences 10, the increase of production costs due to the newly-provided first to fourth sensor terminals 14 can be prevented. Because the module covers A, B having the level differences 10 are used, the sizes of the connectors 11, 12 can be made smaller than the sizes of the module covers A, B. Consequently, the size of the entire sensor module can be reduced, and a space for disposing the sensor module can thereby easily be secured.

The flexible wiring substrate 8 from the first to fourth sensor terminals 14 to the sensor unit is wired around the obstruction (cylindrical boss portion 35) formed on the inner surface of the module covers A, B. Accordingly, the interference between the flexible wiring substrate 8, on which the first to fourth wiring conductor patterns 15 are formed, and the cylindrical boss portion 35 can be prevented. When the first to fourth sensor terminals 14 and the first to fourth wiring conductor patterns 15 are two-level crossed, two or more insulating members of the base film, the insulating film 18, and the mold resin material are located between the first to fourth sensor terminals 14 and the first to fourth wiring conductor patterns 15. As a result, an insulating material does not need to be newly applied; and the first to fourth wiring conductor patterns 15 do not need to be wired for the patterns 15 to greatly circumvent the first to fourth sensor terminals 14, e.g., for lifting up the patterns 15 from the inner surface of the gear accommodating recess toward the bottom face of the gear accommodating recess of the gear housing 22. Consequently, a degree of flexibility in wiring of the sensor wiring unit (particularly, the first to fourth wiring conductor patterns 15) can be improved without causing the increase in the number of components and increase in size.

Second Embodiment

A second embodiment of the invention will be described in reference to FIG. 6.

Similar to the first embodiment, a sensor module of an electronic throttle device of the second embodiment includes a sensor unit having two first and second Hall ICs obtained by integrating together first and second semiconductor Hall elements and first and second voltage amplifiers, module covers A, B having connectors 11, 12, a motor wiring unit from the connectors 11, 12 to vicinity of an electric motor M, and a sensor wiring unit from the connectors 11, 12 to the vicinity of the sensor unit. The motor wiring unit includes first and second motor terminals 13. The sensor wiring unit includes a flexible wiring substrate 8 which has flexibility, and first to fourth sensor terminals 14.

Similar to the first embodiment, the first and second motor terminals 13 and the first to fourth sensor terminals 14 are insert-molded into a mold resin material to be embedded and held in respective terminal wiring parts 7 of the module covers A, B. The flexible wiring substrate 8 is bent perpendicularly at two points corresponding to a level difference 10 formed on an inner surface of the module covers A, B. The flexible wiring substrate 8 is wired (arranged) around an obstruction (cylindrical boss portion 35) formed on the inner surface of the respective terminal wiring parts 7 of the module covers A, B. An opening 63, through which the cylindrical boss portion 35 passes, is formed on the flexible wiring substrate 8. First to fourth wiring conductor patterns 15 are formed on a surface of a base film of the flexible wiring substrate 8.

Figure 6:
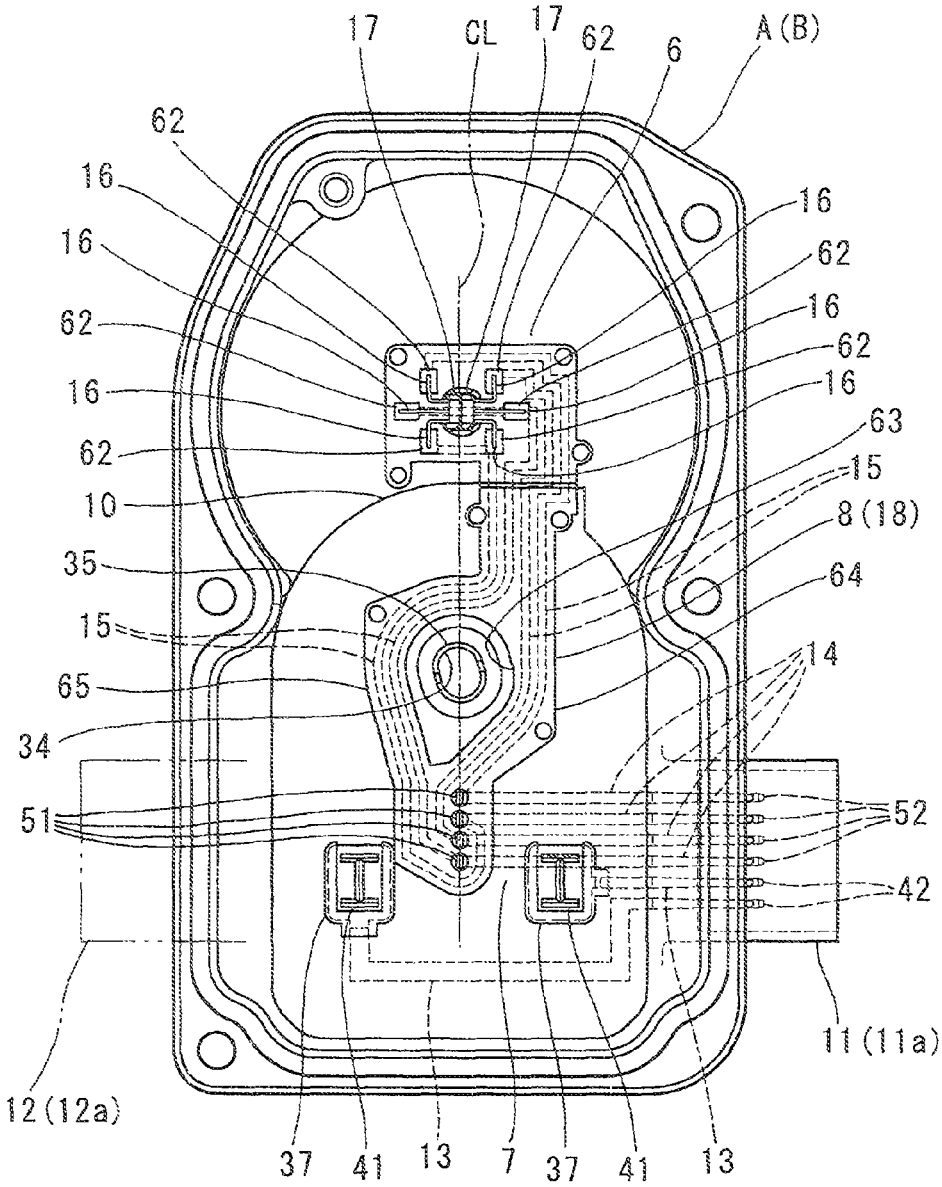
FIG. 6 is a plan view illustrating a motor wiring unit and a sensor wiring unit held by a first module cover (second module cover) in accordance with a second embodiment of the invention.

The flexible wiring substrate 8 includes a first branching portion 64 that branches on a right-hand side of the obstruction (cylindrical boss portion 35) in FIG. 6, and a second branching portion 65 that branches on a left-hand side of the obstruction (cylindrical boss portion 35) in FIG. 6. First and second wiring conductor patterns 15 conduction-joined via a solder material to a lead frame of the sensor unit (first and second sensor leads 16 of two first and second Hall ICs) are formed on a surface of a base film of the first branching portion 64. Third and fourth wiring conductor patterns 15 conduction-joined via a solder material to a lead frame of the sensor unit (third to sixth sensor leads 16 of two first and second Hall ICs) are formed on a surface of a base film of the second branching portion 65.

Electrode pads 61 conduction-joined (soldered) to sensor connecting terminals 51 of the first to fourth sensor terminals 14 via a solder material are formed respectively on one side (terminal side) of the first to fourth wiring conductor patterns 15 in their formation direction. In addition, electrode pads 62 conduction-joined (soldered) via a solder material to the respective first to sixth sensor leads 16 of the sensor unit are formed respectively on the other side (sensor unit side) of the first to fourth wiring conductor patterns 15 in their formation direction. First to fourth openings (terminal side openings) having a circular (or rectangular) shape for exposing the respective electrode pads 61 of the first to fourth wiring conductor patterns 15 on the surface of the flexible wiring substrate 8 are formed on an insulating film 18 of the flexible wiring substrate 8. First to fourth openings (sensor unit side openings) having a rectangular shape for exposing the respective electrode pads 62 of the first to fourth wiring conductor patterns 15 on the surface of the flexible wiring substrate 8 are formed on the insulating film 18 of the flexible wiring substrate 8.

Third Embodiment

Figure 7:
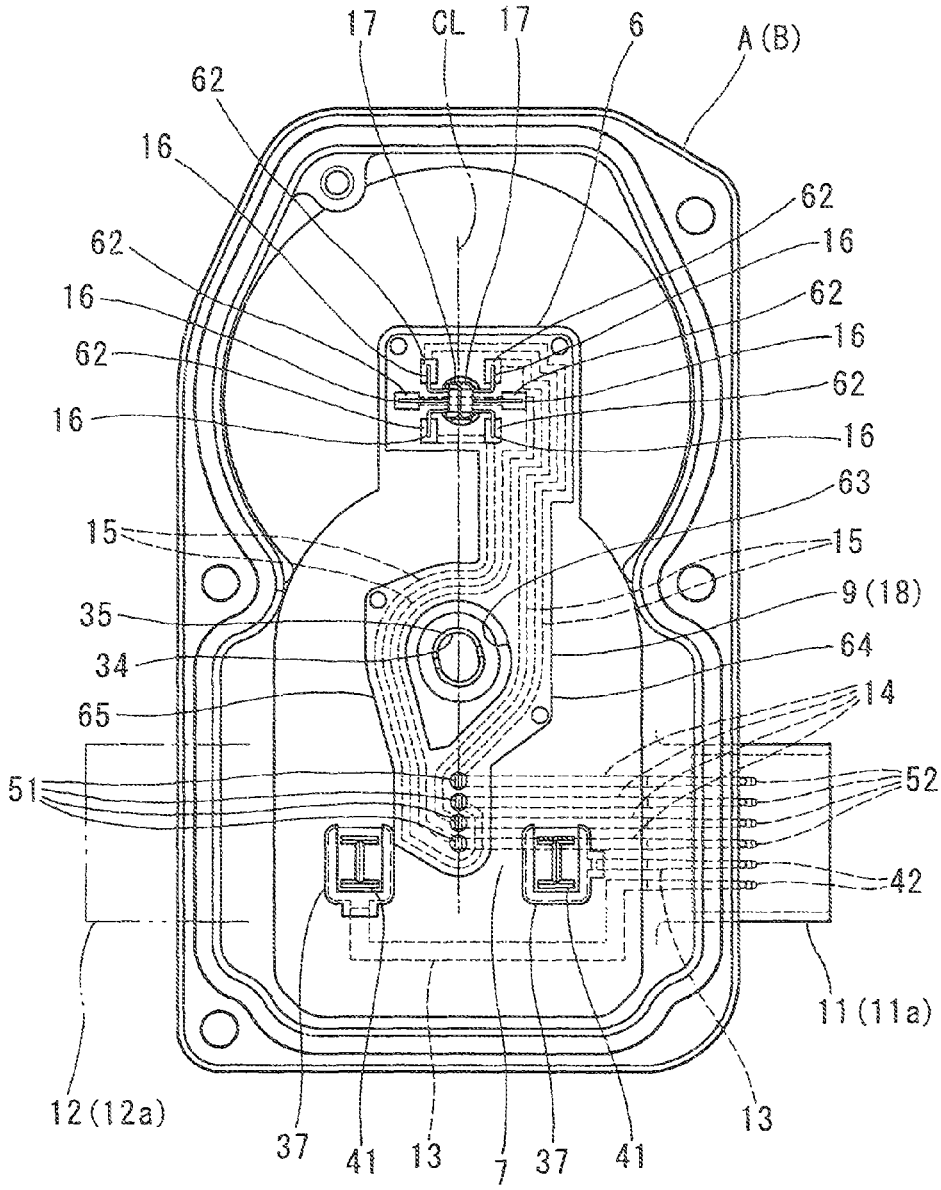
FIG. 7 is a plan view illustrating a motor wiring unit and a sensor wiring unit held by a first module cover (second module cover) in accordance with a third embodiment of the invention.

A third embodiment of the invention will be described in reference to FIG. 7.

Similar to the first and second embodiments, a sensor module of an electronic throttle device of the third embodiment includes a sensor unit having two first and second Hall ICs obtained by integrating together first and second semiconductor Hall elements and first and second voltage amplifiers, module covers A, B having connectors 11, 12, a motor wiring unit from the connectors 11, 12 to vicinity of an electric motor M, and a sensor wiring unit from the connectors 11, 12 to the vicinity of the sensor unit. An inner surface of a sensor mounting portion 6 of the module covers A, B and an inner surface of a terminal wiring part 7 are on the same plane. Accordingly, there is no level difference 10 between the sensor mounting portion 6 and the terminal wiring part 7. The motor wiring unit includes first and second motor terminals 13. The sensor wiring unit includes a glass epoxy wiring substrate 9 which has rigidity, and first to fourth sensor terminals 14.

Similar to the first and second embodiments, the first and second motor terminals 13 and the first to fourth sensor terminals 14 are insert-molded into a mold resin material to be embedded and held in respective terminal wiring parts 7 of the module covers A, B. The glass epoxy wiring substrate 9 includes a base board that is integrally formed from an insulating resin having rigidity, the first to fourth wiring conductor patterns 15 that are formed on a surface of this base board, and an insulating film 18 that is formed to cover these first to fourth wiring conductor patterns 15.

The glass epoxy wiring substrate 9 is wired (arranged) around an obstruction (cylindrical boss portion 35) formed on the inner surface of the respective terminal wiring parts 7 of the module covers A, B. Similar to the second embodiment, an opening 63, through which the cylindrical boss portion 35 passes, is formed on the glass epoxy wiring substrate 9. Similar to the second embodiment, the glass epoxy wiring substrate 9 includes a first branching portion 64 that branches on a right-hand side of the obstruction (cylindrical boss portion 35) in FIG. 7, and a second branching portion 65 that branches on a left-hand side of the obstruction (cylindrical boss portion 35) in FIG. 7. Electrode pads 61 conduction-joined (soldered) to sensor connecting terminals 51 of the first to fourth sensor terminals 14 via a solder material are formed respectively on one side (terminal side) of the first to fourth wiring conductor patterns 15 in their formation direction. In addition, electrode pads 62 conduction-joined (soldered) via a solder material to the respective first to sixth sensor leads 16 of the sensor unit are formed respectively on the other side (sensor unit side) of the first to fourth wiring conductor patterns 15 in their formation direction.

First to fourth openings (terminal side openings) having a circular (or rectangular) shape for exposing the respective electrode pads 61 of the first to fourth wiring conductor patterns 15 on the surface of the glass epoxy wiring substrate 9 are formed on an insulating film 18 of the glass epoxy wiring substrate 9. First to fourth openings (sensor unit side openings) having a rectangular shape for exposing the respective electrode pads 62 of the first to fourth wiring conductor patterns 15 on the surface of the glass epoxy wiring substrate 9 are formed on the insulating film 18 of the glass epoxy wiring substrate 9. The first to fourth wiring conductor patterns 15 may be inner conductors formed in the base board. The first to fourth wiring conductor patterns 15 may be resin-sealed with a mold resin material (sealing agent) having insulation properties instead of the insulating film 18. The first to fourth wiring conductor patterns 15 may be outer conductors formed on a rear face of the base board (gear accommodating recess bottom-face side of the module covers A, B).

Modifications of the above embodiments will be described. In the present embodiment, the sensor module of the invention is applied to the throttle opening degree sensor that detects the opening degree of the throttle valve 2 of the internal combustion engine (engine). Alternatively, the sensor module may be applied to a valve opening degree sensor that detects an opening degree of another rotary type valve. Moreover, the sensor module of the invention may be applied to a rotation angle detecting unit that detects not only the rotation angle of the valve, which is a measuring object, but a rotation angle of another rotor (rotatable shaft or rotating body) such as a crankshaft, a wheel axis of the automobile, or a wheel of the automobile.

In the present embodiment, the valve drive unit, which drives the shaft 3 of the throttle valve 2, is configured by means of the electric actuator including the electric motor M and the power transmission mechanism. Alternatively, the valve drive unit which drives the shaft of the valve may be configured using a negative pressure-operated actuator having an electromagnetic or electric negative pressure control valve. A diesel engine may be used for the engine. A single cylinder engine as well as the multi-cylinder engine may be employed for the engine.

In the present embodiment, the throttle opening degree sensor (magnetic sensor, Hall sensor) having the semiconductor Hall element that outputs to the external circuit (e.g., ECU) the voltage signal corresponding to the rotation information (e.g., rotation angle and rotation direction) of the throttle valve 2, which is the measuring object, is employed for the semiconductor device that outputs the signal corresponding to the information of a measuring object to the outside. Alternatively, a physical information sensor including a semiconductor device (sensor element) that outputs an electrical signal corresponding to physical information of a measuring object (e.g., light, magnetism, displacement, temperature, pressure, flow rate, sound) to the outside, may be used.

To sum up, the sensor module in accordance with the above embodiments may be described as follows.

The sensor module is for detecting information about a measuring object 2. The sensor module includes a sensor, a module cover A, B, and a wiring unit 8, 9, 14, 15. The sensor includes a semiconductor device configured to output to an outside a signal which corresponds to the information about the measuring object 2. The module cover A, B holds the sensor and includes a connector 11, 12 configured to make a connection with an external device. The wiring unit 8, 9, 14, 15 is held by the module cover A, B and is arranged from the connector 11, 12 to the sensor. The wiring unit 8, 9, 14, 15 includes a connecting member 14 and a wiring member 8, 9, 15. The connecting member 14 extends from the connector 11, 12 to a central region of the module cover A, B in its width direction, which is perpendicular to a central line CL of the module cover A, B in a longitudinal direction thereof. The wiring member 8, 9, 15 extends from the central region of the module cover A, B in its width direction to a vicinity of the sensor. The module cover A, B and the connecting member 14 are integrally formed from a mold material having insulation properties. The connecting member 14 integrally includes a first connecting terminal 51 that is exposed from a surface of the mold material at the central region of the module cover A, B in its width direction. The wiring member 8, 9, 15 integrally includes a second connecting terminal 61 that is conductively joined to the first connecting terminal 51. The wiring member is a relay wiring member that makes a relay-connection between the connecting member and the sensor. Accordingly, the wiring unit (connecting member) from the connector to the first connecting terminal, and the wiring unit (wiring member) from the second connecting terminal conduction-joined to the first connecting terminal of this connecting member to the vicinity of the sensor can be separately provided. As a result, since the wiring member from the second connecting terminal to the vicinity of the sensor can be two-level crossed relative to the connecting member, a degree of flexibility in wiring of the wiring unit (particularly, wiring member) can be improved. Accordingly, the connecting member can be used for the module cover shape of the type of the reversed connector direction by rotating the connecting member by a predetermined angle (e.g., 180 degrees) with the imaginary central axis at the central part of the module cover in the width direction serving as the rotation center. As a result, increase of production costs due to a newly-provided connecting member can be prevented, even though a module cover having a different shape from an existing module cover is produced. Because the wiring unit from the connector to the sensor is divided between the connecting member and the wiring member, the length of the connecting member as a single body, i.e., the connecting member formed integrally with the mold material, which is formed into the module cover, is shortened. Consequently, the connecting member is not deformed at the time of its integral-molding with the module cover, and the size of the sensor module is standardized to reduce the level of defectiveness. As a result, the productivity of the sensor module can be improved.

The sensor is, for example, a sensor unit mounted on the module cover. This sensor unit includes a sensor chip on which a semiconductor device is mounted, a sensor lead (lead frame) conduction-joined to the semiconductor device, and a package in which the sensor chip and the sensor lead are sealed with a sealing agent having insulation properties. A third connecting terminal that projects and is exposed from a surface of the package is provided integrally with the sensor lead. A fourth connecting terminal that is conduction-joined to the third connecting terminal is provided integrally with the wiring member. A semiconductor Hall element that outputs a signal corresponding to rotation information (rotation angle, rotation direction) about a rotor (e.g., valve, shaft, gear), which is a measuring object, to the outside (external circuit, electronic control unit) may be used for the semiconductor device. Moreover, a semiconductor pressure detecting element that outputs a signal corresponding to pressure information of fluid, which is the measuring object, to the outside (external circuit, electronic control unit), may be used for the semiconductor device.

A terminal conductor group (terminals, metallic conductor plates) extending in the width direction of the module cover is employed for the connecting member. The connecting member may be inserted (embedded) in the module cover. Therefore, the connecting member may be insert-molded in the mold material, which is formed into the module cover. Accordingly, the connecting member is held by the module cover. As a result, a position shift between the wiring member, which is held similarly by the module cover, and the connecting member is not made. In addition, the wiring member may be held by the module cover on an inner surface of the module cover. For example, the wiring member may be held by the module cover with the wiring member exposed from a surface of the mold material, which is formed into the module cover. In this case, a position shift between the sensor held similarly by the module cover or the wiring member, and the connecting member is not made.

A flexible wiring substrate extending in the longitudinal direction of the module cover is employed for the wiring member from the connecting member to the sensor. A terminal conductor group (terminals, metallic conductor plates) extending in the width direction of the module cover may be employed for the connecting member from the connector to the flexible wiring substrate. The flexible wiring substrate serving as the wiring member from the connecting member to the sensor may be constituted of a base film having flexibility, a wiring conductor pattern formed on a front or rear surface of this base film, an insulating film formed to cover this wiring conductor pattern, and so forth. If the connecting member and the wiring conductor pattern are two-level crossed, two or more insulating members of the base film, the insulating film, and the mold material are located between the connecting member and the wiring conductor pattern. Thus, an insulating material does not need to be newly applied, and the wiring conductor pattern does not need to be wired considerably around the connecting member. Consequently, a degree of flexibility in wiring of the wiring unit (particularly, wiring member) can be improved without causing the increase in the number of components and increase in size.

A glass epoxy wiring substrate extending in the longitudinal direction of the module cover is used for the wiring member from the connecting member to the sensor. A terminal conductor group (terminals, metallic conductor plate) extending in the width direction of the module cover may be used for the connecting member from the connector to the glass epoxy. The glass epoxy wiring substrate as the wiring member from the connecting member to the sensor may be configured using a base board having rigidity and the wiring conductor pattern formed on a front or rear surface of this base board, for example. If the connecting member and the wiring conductor pattern are two-level crossed, at least one insulating member of the base board and the mold material is located between the connecting member and the wiring conductor pattern. Thus, an insulating material does not need to be newly applied, and the wiring conductor pattern does not need to be wired considerably around the connecting member. Consequently, a degree of flexibility in wiring of the wiring unit (particularly, wiring member) can be improved without causing the increase in the number of components and increase in size. In addition, for the glass epoxy wiring substrate, there are also a type of a substrate including an insulating sheet to cover the wiring conductor pattern, and a type of a substrate, in which the wiring conductor pattern is provided as an inner conductor in the glass epoxy wiring substrate.

The module cover A, B may further include a mounting portion 6 that holds the sensor; and a wiring part 7 at which the connecting member 14 is wired. The mounting portion 6 and the wiring part 7 may be configured respectively on both end sides of the module cover A, B in the longitudinal direction of the module cover A, B with a predetermined distance therebetween. The module cover A, B may further include at least one level difference 10 between the wiring part 7 and the mounting portion 6. Accordingly, even if the module cover has at least one level difference, the increase of production costs due to a newly-provided connecting member can be prevented. Because the module cover having at least one level difference is used, the size of the connector can be made smaller than the size of the module cover. Consequently, the size of the entire sensor module can be reduced, and a space for disposing the sensor module can thereby easily be secured. The wiring member from the connecting member to the sensor is wired around an obstruction formed on the inner surface of the module cover, so that interference between the wiring member and the obstruction can be prevented.

The module cover A, B may be one of a first module cover A and a second module cover B, which have different shapes from each other. The connector 11, 12 may be one of a first connector 11 of the first module cover A and a second connector 12 of the second module cover B. The first module cover A and the second module cover B may have such plane-symmetrical shapes that a direction of fitting of the first connector 11 into the external device and a direction of fitting of the second connector 12 into the external device are reversed by 180 degrees relative to each other and face in opposite directions from each other, with a plane, which passes through the central region of the module cover A, B in its width direction and includes the central line CL of the module cover A, B in its longitudinal direction, serving as a symmetry plane. The connecting member 14 may be one group of two groups of terminal conductors 14, which have identical shapes and are provided respectively for the first module cover A and the second module cover B. The two groups of terminal conductors 14 may have rotational symmetry shapes relative to each other with a central axis of the central region of the module cover A, B in its width direction serving as a symmetry center. Accordingly, one terminal conductor group of the two terminal conductor groups has a rotational symmetry shape which overlaps with a shape of the other terminal conductor group of the two terminal conductor groups through its rotation (reverse by 180 degrees) by a predetermined angle with the central axis of the central part of the first and second module covers in their width direction that is perpendicular to the central line of the first and second module covers in their longitudinal direction serving as the rotation center.

Additional advantages and modifications will readily occur to those skilled in the art. The invention in its broader terms is therefore not limited to the specific details, representative apparatus, and illustrative examples shown and described.

What is claimed is:

1. A sensor module comprising:

a sensor that includes a semiconductor device configured to output to an outside a signal which corresponds to information about a measuring object;

a module cover that holds the sensor and includes a connector configured to make a connection with an external device; and a wiring unit that is held by the module cover and is arranged from the connector to the sensor, wherein:

the wiring unit includes:

a connecting member extending from the connector to a central region of the module cover in its width direction, which is perpendicular to a central line of the module cover in a longitudinal direction thereof; and a wiring member extending from the central region of the module cover in its width direction to a vicinity of the sensor;

the module cover and the connecting member are integrally formed from a mold material having insulation properties;

the connecting member includes a first connecting terminal that is exposed from a surface of the mold material at the central region of the module cover in its width direction;

the wiring member includes a second connecting terminal that is conductively joined to the first connecting terminal;

the module cover is any one of a first module cover and a second module cover, which have different shapes from each other; and the first module cover and the second module cover have such plane-symmetrical shapes that a direction of fitting of a first connector of the first module cover into the external device and a direction of fitting of a second connector of the second module cover into the external device are reversed by 180 degrees relative to each other and face in opposite directions from each other, with a plane, which passes through the central region of the module cover in its width direction and includes the central line of the module cover in its longitudinal direction, serving as a symmetry plane.

2. The sensor module according to claim 1, wherein:

the sensor further includes:

a sensor chip on which the semiconductor device is mounted;

a sensor lead that is conductively joined to the semiconductor device; and a package in which the sensor chip and the sensor lead are sealed with a sealing agent having insulation properties;

the sensor lead includes a third connecting terminal that projects and is exposed from a surface of the package; and the wiring member further includes a fourth connecting terminal that is conductively joined to the third connecting terminal.

3. The sensor module according to claim 1, wherein the connecting member is a terminal conductor group extending in the width direction of the module cover.

4. The sensor module according to claim 1, wherein the wiring member is a flexible wiring substrate extending in the longitudinal direction of the module cover.

5. The sensor module according to claim 1, wherein the wiring member is a glass epoxy wiring substrate extending in the longitudinal direction of the module cover.

6. The sensor module according to claim 1, wherein:

the module cover further includes:

a mounting portion that holds the sensor; and a wiring part at which the connecting member is wired; and the mounting portion and the wiring part are configured respectively on both end sides of the module cover in the longitudinal direction of the module cover with a predetermined distance therebetween.

7. The sensor module according to claim 6, wherein the module cover further includes at least one level difference between the wiring part and the mounting portion.

8. The sensor module according to claim 1, wherein:

the module cover further includes an obstruction formed on an inner surface thereof; and the wiring member is wired to be diverted around the obstruction.

9. A sensor module comprising:

a sensor that includes a semiconductor device configured to output to an outside a signal which corresponds to information about a measuring object;

a module cover that holds the sensor and includes a connector configured to make a connection with an external device; and a wiring unit that is held by the module cover and is arranged from the connector to the sensor, wherein:

the wiring unit includes:

a connecting member extending from the connector to a central region of the module cover in its width direction, which is perpendicular to a central line of the module cover in a longitudinal direction thereof; and a wiring member extending from the central region of the module cover in its width direction to a vicinity of the sensor;

the module cover and the connecting member are integrally formed from a mold material having insulation properties;

the connecting member includes a first connecting terminal that is exposed from a surface of the mold material at the central region of the module cover in its width direction;

the wiring member includes a second connecting terminal that is conductively joined to the first connecting terminal;

the module cover is any one of a first module cover and a second module cover, which have different shapes from each other;

the first module cover and the second module cover have such plane-symmetrical shapes that a direction of fitting of a first connector of the first module cover into the external device and a direction of fitting of a second connector of the second module cover into the external device are reversed by 180 degrees relative to each other and face in opposite directions from each other, with a plane, which passes through the central region of the module cover in its width direction and includes the central line of the module cover in its longitudinal direction, serving as a symmetry plane;

the sensor module further comprises:

a first group of terminal conductors as the connecting member formed integrally with the first module cover; and a second group of terminal conductors as the connecting member formed integrally with the second module cover;

the first group of terminal conductors and the second group of terminal conductors have identical shapes; and the first group of terminal conductors and the second group of terminal conductors have rotational symmetry shapes relative to each other with the central line of the module cover in the longitudinal direction thereof at the central region of the module cover in its width direction serving as a symmetry axis center.

* * * * *